US010932602B2

(12) United States Patent
Hauck

(10) Patent No.: US 10,932,602 B2
(45) Date of Patent: Mar. 2, 2021

(54) THEFT PREVENTION PACKAGE CONTAINERS

(71) Applicant: Jerry L. Hauck, Broussard, LA (US)

(72) Inventor: Jerry L. Hauck, Broussard, LA (US)

( * ) Notice: Subject to any disclaimer, the term of this patent is extended or adjusted under 35 U.S.C. 154(b) by 49 days.

(21) Appl. No.: 16/394,404

(22) Filed: Apr. 25, 2019

(65) Prior Publication Data

US 2020/0093310 A1 Mar. 26, 2020

Related U.S. Application Data

(60) Provisional application No. 62/733,768, filed on Sep. 20, 2018.

(51) Int. Cl.

| | |
|---|---|
| ***A47G 29/20*** | (2006.01) |
| ***A47G 29/26*** | (2006.01) |
| ***A47G 29/12*** | (2006.01) |
| *A47G 29/14* | (2006.01) |

(52) U.S. Cl.

CPC ..... *A47G 29/20* (2013.01); *A47G 29/12095* (2017.08); *A47G 29/26* (2013.01); *A47G 2029/144* (2013.01)

(58) Field of Classification Search

CPC .. A47G 29/1216; A47G 29/124; A47G 29/14; A47G 29/16; A47G 29/20; A47G 29/24; A47G 29/26; A47G 2029/144; A47G 2029/148; A47G 29/12095; A47G 2029/1257

USPC ..... 232/19, 39, 45, 43.2, 30–32, 43.1, 43.5, 232/42, 44

See application file for complete search history.

(56) References Cited

U.S. PATENT DOCUMENTS

| | | | | |
|---|---|---|---|---|
| 2,421,221 | A * | 5/1947 | Rothe | B07C 7/04 232/30 |
| 3,981,436 | A * | 9/1976 | Neal | A47G 29/1207 232/17 |
| 4,013,215 | A * | 3/1977 | Mercier | B65F 1/0093 232/43.1 |
| 4,363,438 | A * | 12/1982 | Connor | A47G 29/1207 232/30 |
| 5,137,212 | A * | 8/1992 | Fiterman | B65F 1/10 109/46 |
| 5,624,071 | A * | 4/1997 | Sosan | A47G 29/20 232/1 B |
| 6,155,715 | A * | 12/2000 | Lake | A47G 29/20 150/102 |
| 6,375,070 | B1 * | 4/2002 | Snoke | A47G 29/141 232/20 |
| 6,533,167 | B2 * | 3/2003 | Hassan | A47G 29/1216 232/17 |
| 7,234,633 | B2 * | 6/2007 | Day | A47G 29/1207 232/30 |
| 9,230,230 | B2 | 1/2016 | Gupta et al. | |
| 9,596,952 | B2 * | 3/2017 | Mencel | A47G 29/141 |
| 9,873,549 | B2 * | 1/2018 | Heinz | A47G 29/141 |
| 10,143,321 | B2 * | 12/2018 | Hippert | A47G 29/20 |
| 10,321,780 | B1 * | 6/2019 | James | A47G 23/06 |

(Continued)

*Primary Examiner* — William L Miller

(74) *Attorney, Agent, or Firm* — Lapple Ubell IP Law, LLP; Franklin D. Ubell

(57) ABSTRACT

A theft prevention package container having a package chute positioned in a top surface thereof and a slot positioned on a back surface thereof to receive a lower end of a garage door so as to hold the package container in a position where it is locked in place by the garage door.

20 Claims, 7 Drawing Sheets

(56) References Cited

U.S. PATENT DOCUMENTS

| | | | | |
|---|---|---|---|---|
| 10,383,471 | B1 * | 8/2019 | Barnes | A47G 29/20 |
| 10,512,352 | B1 * | 12/2019 | Torres | A47G 29/22 |
| 10,537,197 | B2 * | 1/2020 | Hopp | A47G 29/20 |
| 10,583,853 | B2 * | 3/2020 | Brilhante | A47G 29/141 |
| 10,682,002 | B2 * | 6/2020 | Miller | A47G 29/20 |
| 2016/0051073 | A1 * | 2/2016 | Heinz | A47G 29/141<br>232/39 |
| 2016/0068306 | A1 * | 3/2016 | Heinz | B65D 81/02<br>220/560.01 |
| 2016/0309939 | A1 * | 10/2016 | Mencel | A47G 29/20 |
| 2017/0007058 | A1 * | 1/2017 | Nuckols | A47G 29/14 |
| 2017/0127868 | A1 * | 5/2017 | Adewuyi | A47G 29/141 |
| 2017/0188737 | A1 * | 7/2017 | Hippert | A47G 29/20 |
| 2018/0177320 | A1 | 6/2018 | Chambers et al. | |
| 2018/0296016 | A1 | 10/2018 | Teoh | |
| 2019/0246828 | A1 * | 8/2019 | Miller | A47G 29/20 |
| 2019/0256119 | A1 * | 8/2019 | Brilhante | A47G 29/124 |
| 2019/0350398 | A1 * | 11/2019 | Raphael | A47G 29/141 |

* cited by examiner

THEFT PREVENTION PACKAGE CONTAINERS

REFERENCE TO RELATED APPLICATIONS

The subject application claims the benefit of and priority to U.S. Provisional Patent Application Ser. No. 62/733,768, filed Sep. 20, 2018, the contents of which application is incorporated by reference herein in its entirety.

BACKGROUND

Field of the Invention

The subject invention relates to prevention of theft of packages which are typically left on a doorstep by various package delivery services.

Description of Related Art

Conventionally, delivery services place packages on a front door step of a residence where they are subject to being stolen. With the advent of on-line sales and delivery of purchased items to the home, the package theft problem has increased significantly.

SUMMARY

According to an illustrative embodiment, a theft prevention package container is provided having a package chute positioned in a top surface thereof and a slot on a rear or back surface shaped and positioned to receive a lower end of a garage door such that the garage door holds the container in a position where it is locked in place by the garage door.

According to another aspect, a box-shaped package container is provided having a hollow package chute positioned in a top surface thereof, the package chute having an exterior opening configured to receive one or more packages inserted therethrough and an interior opening configured such that packages inserted into the exterior opening can drop into a bin located in the interior of the package container. A retainer member is attached to a back surface of the package container and has a slot at lower end thereof, the slot being of a shape selected to receive a lower end of a door such that the door holds the package container in a position where it is locked in place by the door.

In one illustrative embodiment, the slot is shaped to receive a garage door. In one illustrative embodiment, the slot is u-shaped in cross-section. In one illustrative embodiment, the package chute is further shaped to prevent human access through the chute to packages which have been dropped into the container.

In another illustrative embodiment, the back surface of the package container includes first and second vertical slots formed therein, and the retainer member is attached to the back surface of the package container by first and second fastening devices inserted respectively through the first and second slots in the back surface. In one embodiment, the first and second fastening devices are configured to be positionable through a range of vertical positions in the first and second slots to thereby enable positioning of the retainer member in a selected one of a range of vertical positions. Further illustrative embodiments are described below.

DETAILED DESCRIPTION OF ILLUSTRATIVE EMBODIMENTS

Figure 1:
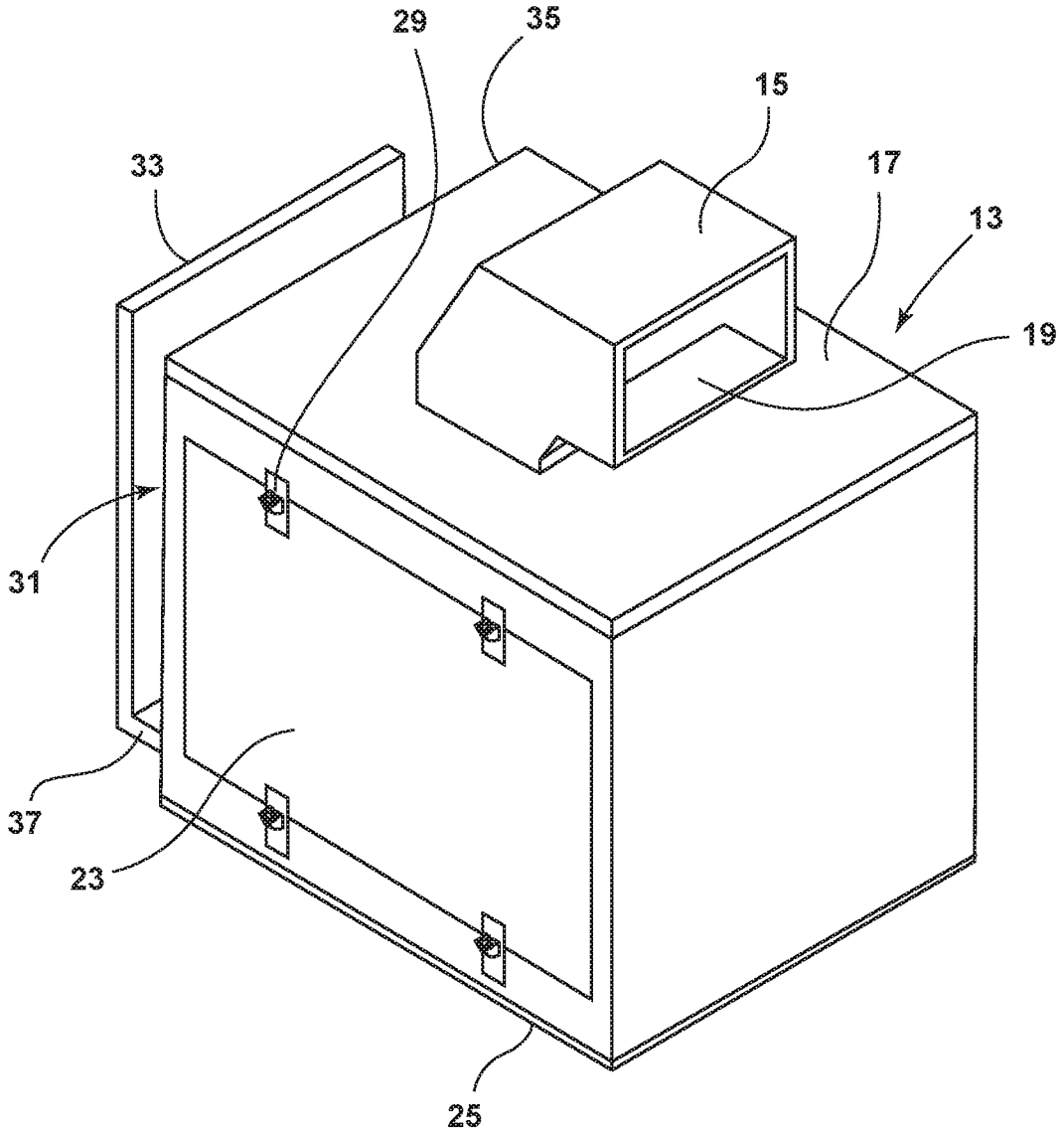
FIG. 1 is a perspective view of a theft prevention package container according to an illustrative embodiment.
Figure 2:
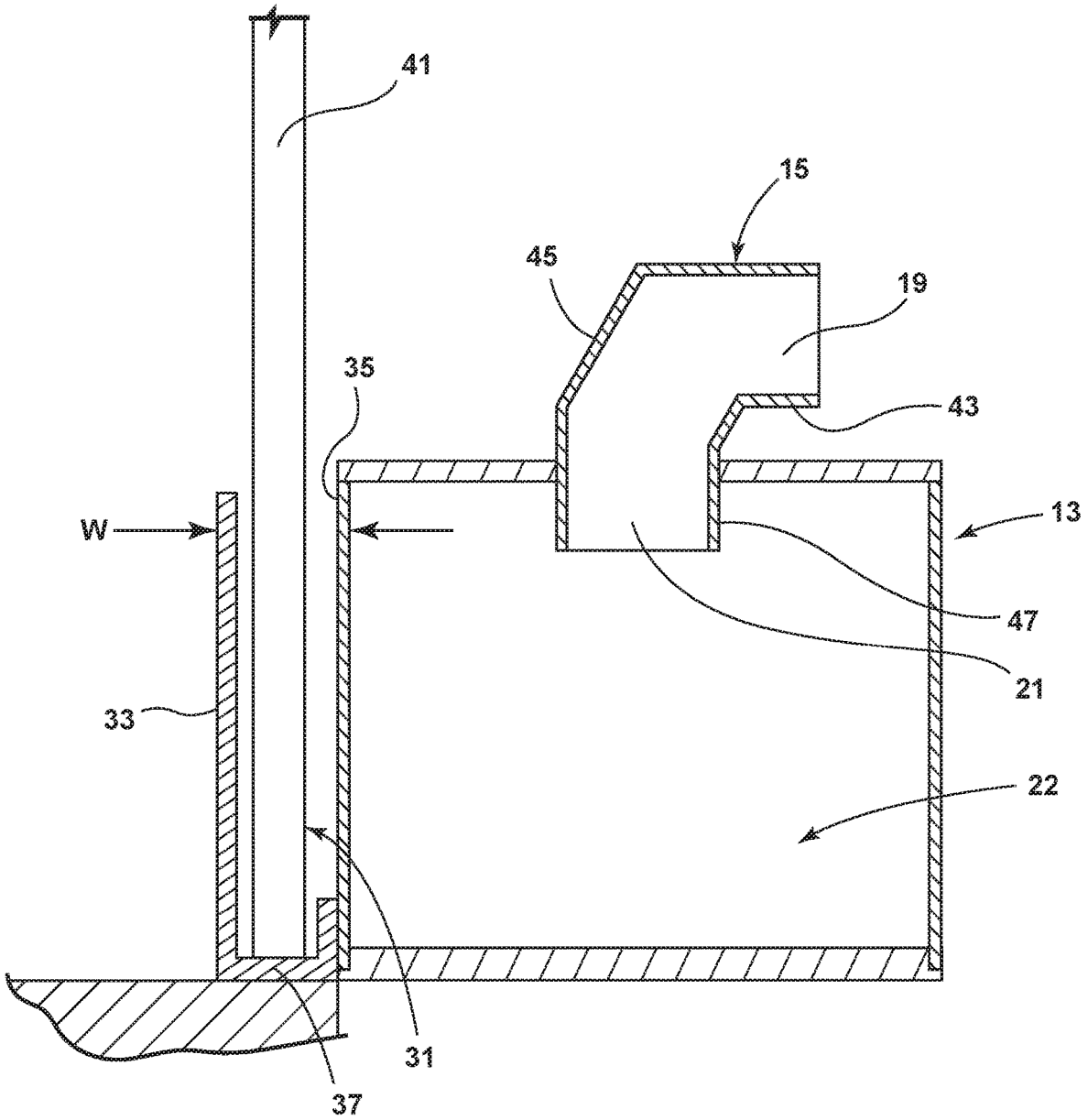
FIG. 2 is a side sectional view of the apparatus of FIG. 1.
Figure 3:
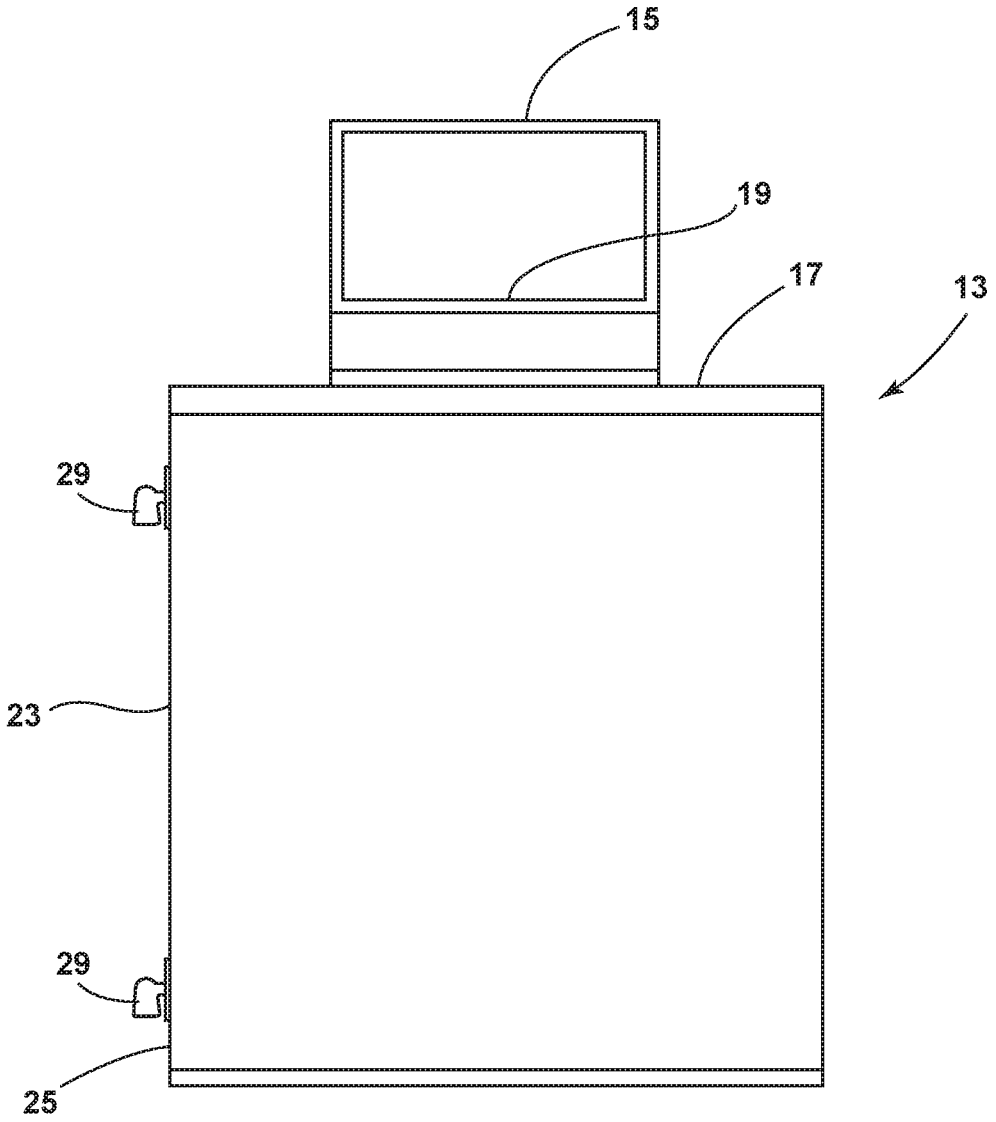
FIG. 3 is a front view of the apparatus of FIG. 1.

FIGS. 1-3 show an illustrative embodiment of a theft prevention package container according to an illustrative embodiment. The illustrative embodiment employs a box-shaped container 13 having a package chute 15 positioned in a top surface thereof. As shown in FIG. 2, the package chute 15 has an exterior opening 19 through which packages may be inserted and an interior opening 21 through which packages can drop into a bin 22 in the interior of the container 13. The container 13 further has a package access door 23 hingedly mounted to a side 25 thereof via hinges 27. In one embodiment, a master lock 29 secures the door 23 in a closed position. In another embodiment, an opening can be provided in the back 35 of the container 13 so that no locks or hinges are required. Such an opening would be closed off by the garage or other door 41 shown in FIG. 2.

A slot 31 is formed at the rear of the container 13 by spacing a vertical wall 33 apart from a rear vertical wall 35 of the container 13. In one embodiment, the vertical wall 33 includes a horizontal foot 37, which may be welded or otherwise attached to the vertical rear wall 35 of the container 13 at a lower end thereof. In one embodiment, the rear wall 33 and horizontal foot 37 comprise a single piece unit. In such an embodiment, the container 13 may comprise rectangular metal plates welded or otherwise fastened together.

In another embodiment, the vertical wall 33, horizontal foot 37, and box-shaped container 13 are formed as a single piece unit, for example, by molding it from plastic. In one embodiment, the vertical wall 33 and vertical wall 35 are each rectangular in shape. In one embodiment, the wall 33 is a smaller rectangle than the wall 35, but that does not need to be the case.

In an illustrative embodiment, the width "W" (FIG. 2) of the slot 31 is selected to be sufficient to permit a garage or other door 41 to be lowered into a closed position where the container 13 is held or locked in position by the door 41. In this manner, a homeowner or other person leaving the house can position the container 13 beneath the garage door 41 and then lower the garage door 41 to hold or lock the container 13 in position, for example, between the bottom edge of the door 41 and the floor 43 of a garage, thereby providing a safe and secure receptacle for packages delivered by a delivery service or other source such as FedEx, UPS, US mail, Amazon or Amazon-drone, Walmart, etc.

As shown in FIG. 2, in one embodiment, the package chute 15 contains a horizontal input tube portion 43, which forms into an angled elbow portion 45, which then forms into a downwardly or vertically oriented output tube 47. In one embodiment, the elbow 45 is angled to the horizontal. In one embodiment, the chute 15 is formed as a single piece unit of rectangular cross-section and is inserted through a conformingly-shaped rectangular opening in the top of the container 13 and welded or otherwise fixed in place. The chute 15 and container 13 are further configured such that a person cannot reach through the chute 15 to attempt to remove packages or other items therefrom. In illustrative embodiments, the size of the opening 19 in the chute 15 can vary, for example, in response to customer request.

In various embodiments, the container 13 can be constructed of indestructible material such as, for example, an unbreakable plastic or carbon fiber material. Security can be enhanced by molding chicken wire or similar material into the structure of the container 13 to make it resistant or impervious to saw cuts.

In another embodiment, a container can be constructed to fold flat by hinging together separate side panels of a container similar to container 13. In one embodiment, use of a chute like chute 15 can be avoided by employing a slot in a soft elastic material such that packages may be inserted through the elastic slot but cannot be removed from the container thereafter.

Figure 4:
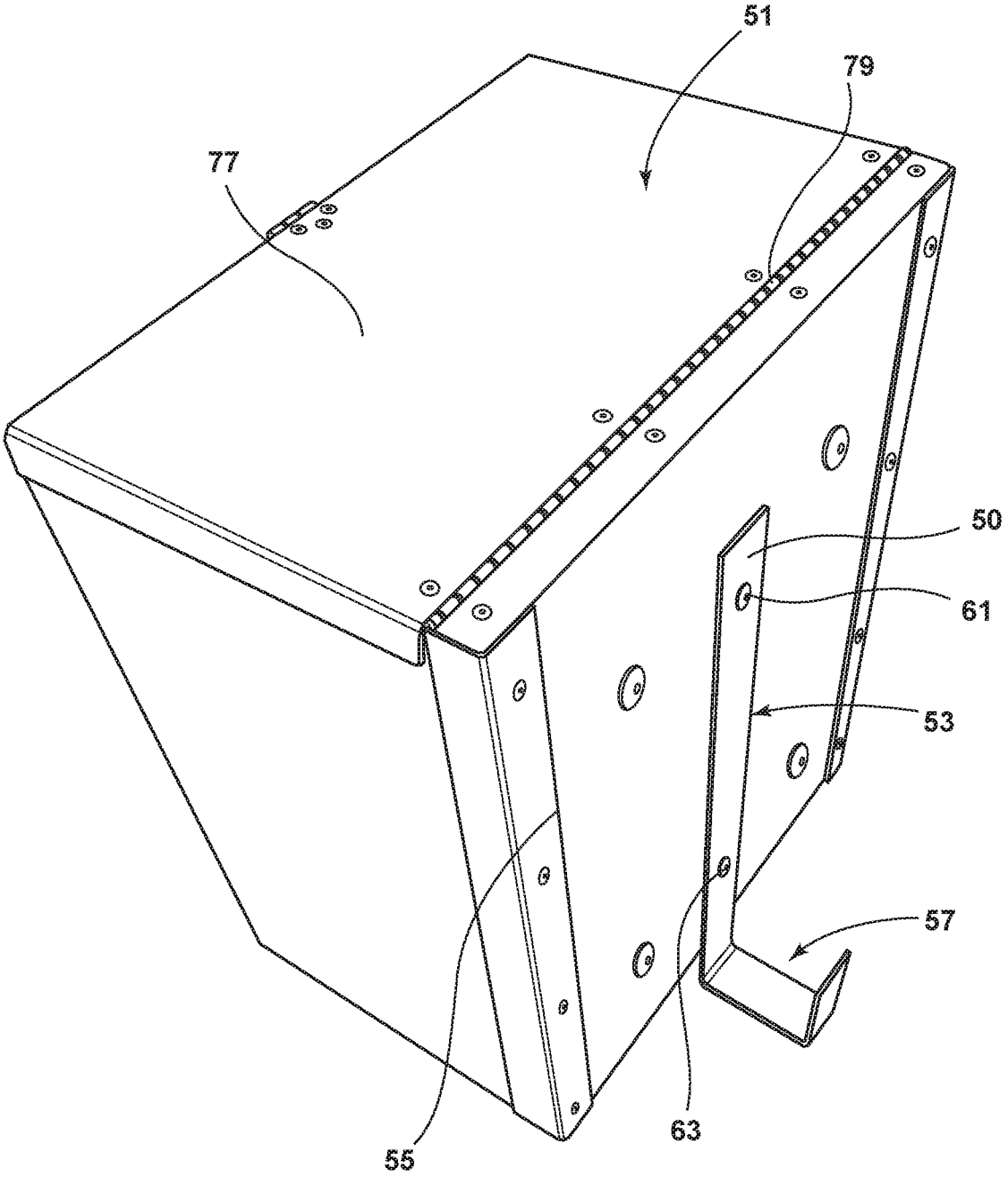
FIG. 4 is a rear perspective view of an alternate embodiment.
Figure 5:
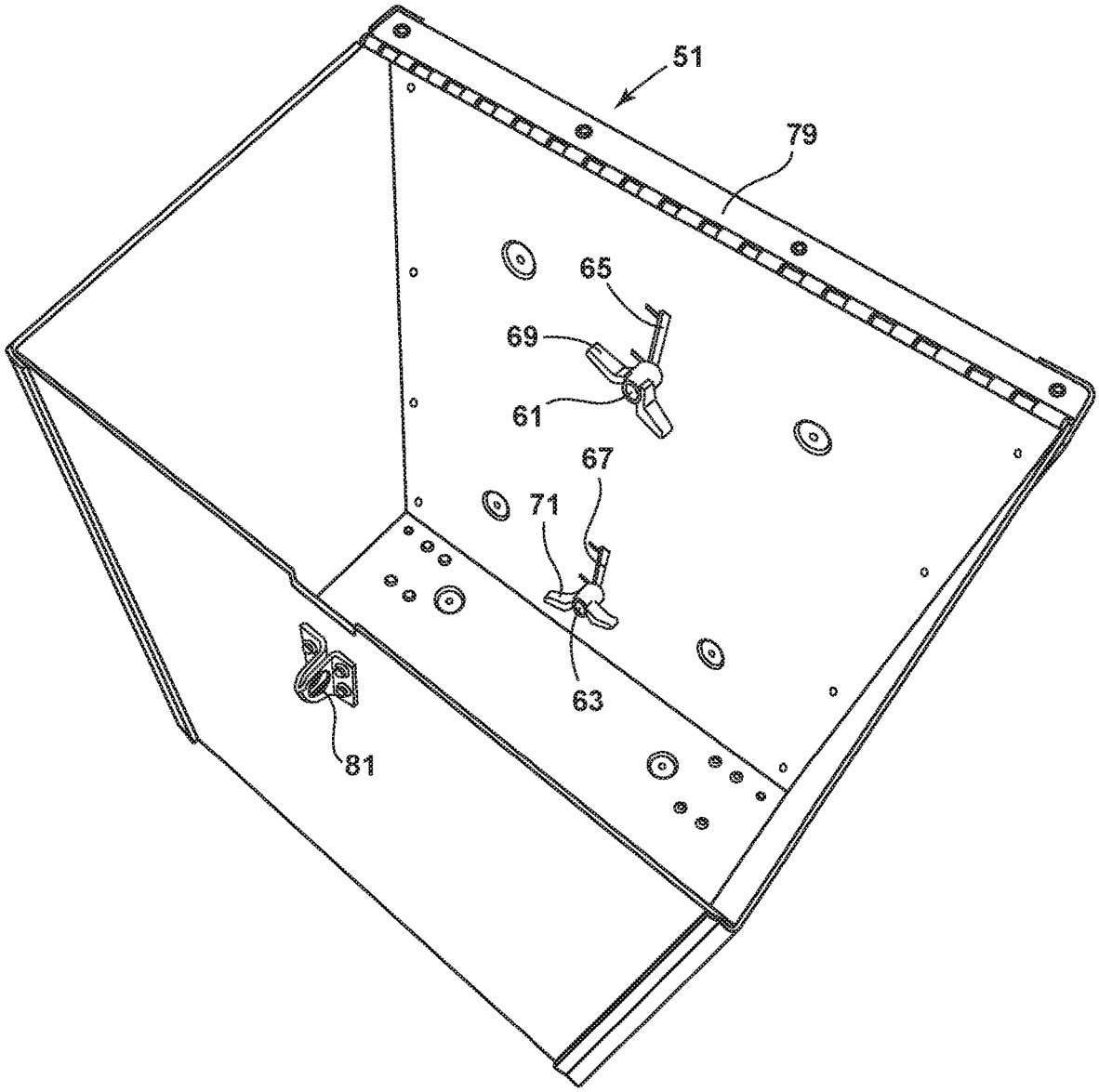
FIG. 5 is a perspective view of the interior of the embodiment of FIG. 4.
Figure 6:
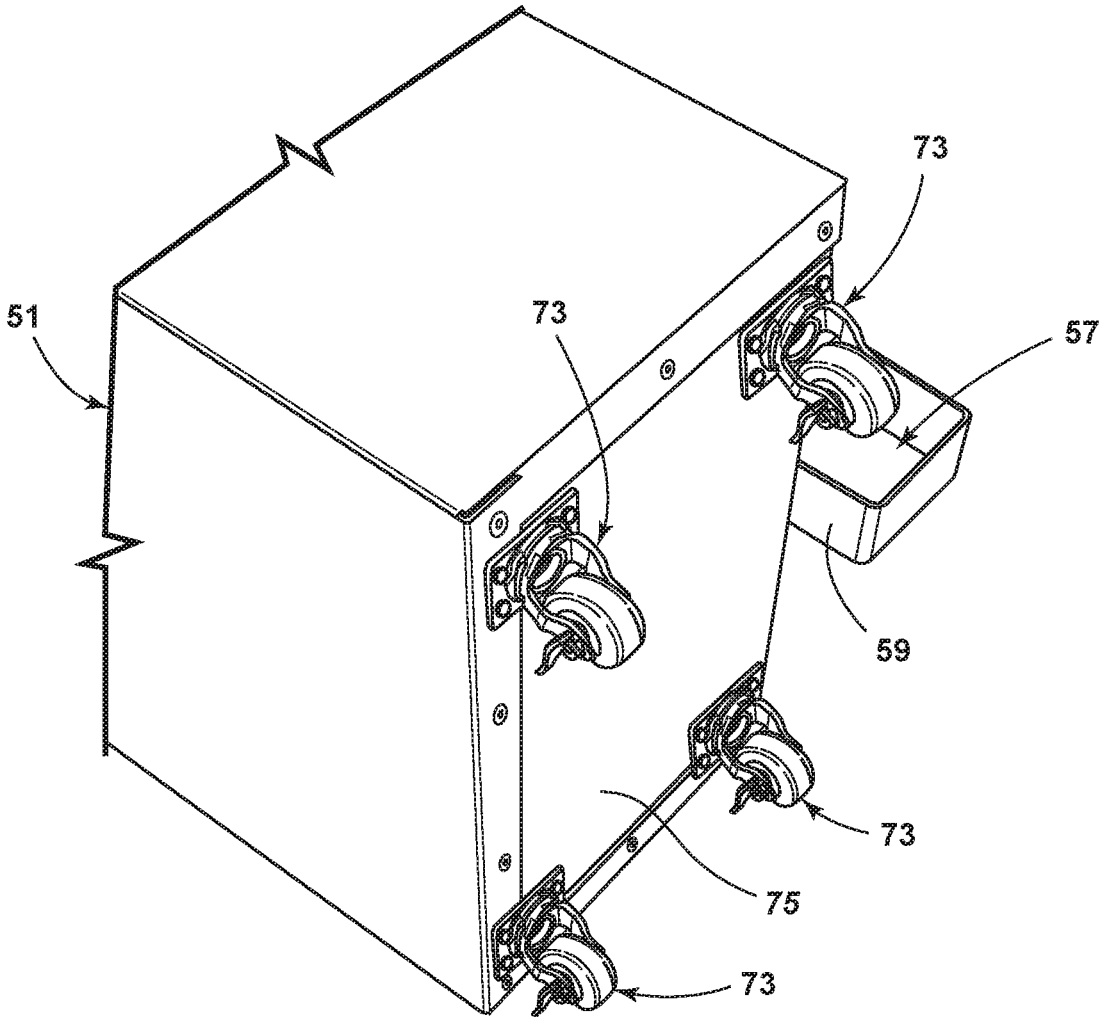
FIG. 6 is a perspective view of the bottom of the embodiment of FIG. 5.

An alternate embodiment of a theft prevention container is shown in FIGS. 4-6. As shown, a box-shaped container 51 is provided, which has a single piece retainer member 53 attached to a back surface 55 of the container 51. The retainer 53 may be formed of a single metal piece appropriately bent to establish a u-shaped slot 57, which in illustrative embodiments may receive a garage door or other door to hold the container 51 in place.

A vertical member 59 of the retainer member 53 is fastened to the back 55 of the container by means of two bolts 61, 63, which ride in respective slots 65, 67. As seen in FIG. 5, wing nuts 69, 71 thread on to the respective bolts 61, 63. Loosening the nuts 69, 71 allows the vertical position of the u-shaped slot 57 to be adjusted to facilitate installation of the container 51 in various situations.

Four casters 73 (FIG. 6) may be mounted to the bottom 75 of the container 51 via fastening devices such as screws or bolts to enable rolling the container 51 into position, for example, on a drive way. In one embodiment, the wheels of the casters are lockable once the container 51 is in a desired position to prevent rolling or other movement of the container 51.

In the embodiment of FIGS. 4-6, a lid 77 is mounted to the open top of the container by a suitable hinge 79. The lid 77 may be locked in place by a pad lock inserted through openings in a latch member 81.

Figure 7:
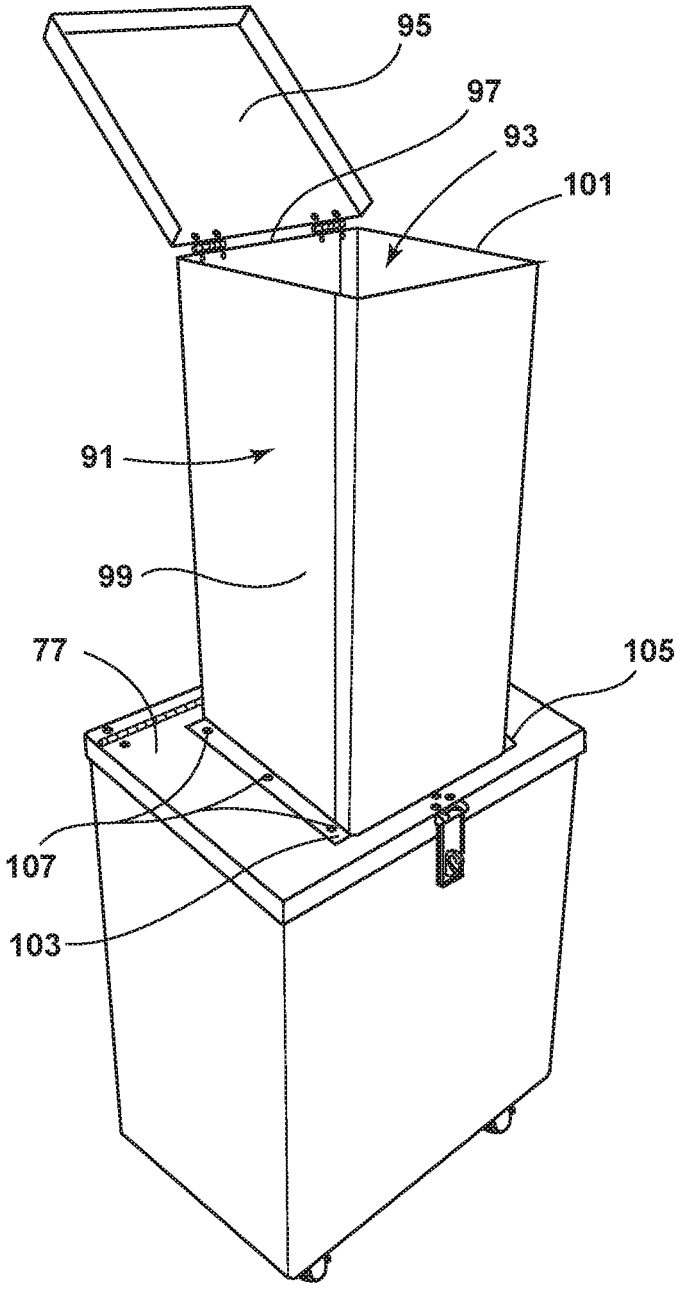
FIG. 7 is a perspective view of an alternate embodiment.

In another embodiment, a package chute similar to chute 15 of FIG. 2 may be formed as part of, or attached to, a lid hingedly mounted to a container such as container 51. FIG. 7 illustrates such an embodiment where a package chute 91 is mounted to a lid 77. In one embodiment of FIG. 7, the chute 91 is formed of sheet metal, is twenty (20) inches high, and has a square opening 93 which is nine (9) inches on a side. Other dimensions of course may be used in other embodiments, and the size of the opening 93 may be selected to receive packages of a particular size. In the embodiment of FIG. 7, a square lid 95 is attached to a back top edge 97 of the chute 91. The bottom edges of respective sides 99, 101 of the chute 91 are bent 90 degrees to form feet 103, 105, which are each attached to the lid 77 by suitable fastening devices 107, for example, such as Allen head bolts or rivets.

In another embodiment, a free standing unit is provided that can be embedded in concrete or otherwise fixed in place in an open area to receive package delivery by drones with pass codes to open a top lid for delivery and thereafter close the lid. Such codes can be mutually established with Amazon or any other delivery service.

In various embodiments, containers can be configured to receive delivery of packages by a drone or other flying device. In one such an embodiment, the container 13 may include a wireless transceiver which can communicate back and forth with a drone. In one embodiment, the chute 15 or other package receptacle can be closed by a lid which can be opened in response to a code transmitted to the transceiver by the drone and which thereafter closes to seal off the container 13. In one embodiment, the drone may navigate to a residence using GPS and then may use WiFi to "home in" on the package container and to transmit the code which causes a motor driven access door of the container to open.

From the foregoing, those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. Apparatus comprising:

a box-shaped package container having a hollow package chute positioned on a top surface thereof, the package chute having an exterior opening configured to receive one or more packages inserted therethrough and an interior opening configured such that packages inserted into the exterior opening drop into a bin located in the interior of the package container;

a retainer member attached to a back surface of said package container and having a slot at lower end thereof, the slot being of a shape selected to receive a lower end of a door such that the door holds the package container in a position where it is locked in place by the door; and wherein the back surface of the package container includes first and second vertical slots formed therein and wherein the retainer member is attached to the back surface by first and second fastening devices inserted respectively through said first and second vertical slots.

2. The apparatus of claim 1 wherein said door comprises a garage door.

3. The apparatus of claim 2 wherein the package container has an access opening located in the back surface of the container and positioned to be closed off by the garage door.

4. The apparatus of claim 2 wherein the first and second fastening devices are configured to be positionable through a range of vertical positions in said first and second vertical slots to thereby enable positioning of the slot of said retainer member in a selected range of vertical positions.

5. The apparatus of claim 4 wherein the package chute is so structured and dimensioned as to prevent human access through the chute to packages in said container.

6. The apparatus of claim 1 wherein the slot is u-shaped in cross-section.

7. The apparatus of claim 1 wherein the package chute is so structured and dimensioned as to prevent human access through the chute to packages in said container.

8. The apparatus of claim 1 wherein the first and second fastening devices are configured to be positionable through a range of vertical positions in said first and second vertical slots to thereby enable positioning said retainer member in a selected range of vertical positions.

9. The apparatus of claim 8 wherein the package chute is so structured and dimensioned as to prevent human access through the chute to packages in said container.

10. The apparatus of claim 1 wherein the package container has an access opening located in a side of the container to enable removal of packages.

11. The apparatus of claim 10 wherein the access opening is closed by a hinged lockable door.

12. Apparatus comprising:

a box-shaped package container having a hollow package chute positioned on a top surface thereof, wherein the package chute is hingedly mounted to the container, the package chute having an exterior opening configured to receive one or more packages inserted therethrough and an interior opening configured such that packages inserted into the exterior opening drop into a bin located in the interior of the package container; and a retainer member attached to a back surface of said package container and having a slot at lower end thereof, the slot being of a shape selected to receive a lower end of a door such that the door holds the package container in a position where it is locked in place by the door.

13. The apparatus of claim 12 wherein said door comprises a garage door.

14. The apparatus of claim 13 wherein the package container has an access opening located in the rear vertical wall of the container and positioned to be closed off by the garage door.

15. The apparatus of claim 12 wherein the slot is u-shaped in cross-section.

16. The apparatus of claim 12 wherein the package chute is so structured and dimensioned as to prevent human access through the chute to packages in said container.

17. The apparatus of claim 12 wherein the back surface of the package container includes first and second vertical slots formed therein and wherein the retainer member is attached to the back surface by first and second fastening devices inserted respectively through said first and second vertical slots.

18. The apparatus of claim 17 wherein the first and second fastening devices are configured to be positionable through a range of vertical positions in said first and second vertical slots to thereby enable positioning said retainer member in a selected range of vertical positions.

19. The apparatus of claim 12 wherein the package container has an access opening located in a side of the container to enable removal of packages.

20. The apparatus of claim 19 wherein the access opening is closed by a hinged lockable door.

* * * * *